US007600277B2

(12) United States Patent
Heimbrock

(10) Patent No.: US 7,600,277 B2
(45) Date of Patent: Oct. 13, 2009

(54) FOLDOUT BED HEADWALL STRUCTURE

(75) Inventor: Richard H Heimbrock, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 322 days.

(21) Appl. No.: 11/628,018

(22) PCT Filed: May 31, 2005

(86) PCT No.: PCT/US2005/018965

§ 371 (c)(1),
(2), (4) Date: Nov. 28, 2006

(87) PCT Pub. No.: WO2005/120192

PCT Pub. Date: Dec. 22, 2005

(65) Prior Publication Data

US 2007/0204401 A1 Sep. 6, 2007

Related U.S. Application Data

(60) Provisional application No. 60/576,661, filed on Jun. 3, 2004.

(51) Int. Cl.
*A47C 17/52* (2006.01)
*A47C 19/22* (2006.01)

(52) U.S. Cl. ..... 5/136; 5/159.1; 5/161; 5/2.1; 5/95

(58) Field of Classification Search ..... 5/133, 5/136, 159.1, 160, 161, 164.1, 95, 96, 2.1
See application file for complete search history.

(56) References Cited

U.S. PATENT DOCUMENTS

| | | | | |
|---|---|---|---|---|
| 1,431,299 | A | 10/1922 | Godsell | |
| 2,770,813 | A * | 11/1956 | Marzillier | 5/2.1 |
| 3,046,572 | A | 7/1962 | Eames et al. | |
| 3,514,794 | A * | 6/1970 | Pofferi | 5/2.1 |
| 3,660,591 | A * | 5/1972 | Schultz et al. | 174/70 R |
| 3,694,830 | A * | 10/1972 | Koller | 5/610 |
| 3,769,502 | A * | 10/1973 | Schultz et al. | 362/85 |
| 3,846,853 | A * | 11/1974 | Jacobsson | 5/87.1 |
| 3,921,345 | A * | 11/1975 | Damico | 52/28 |
| 3,971,078 | A * | 7/1976 | Herrera | 5/617 |
| 4,753,055 | A * | 6/1988 | Durham, Jr. | 52/28 |
| 5,033,134 | A * | 7/1991 | Burchett | 5/133 |
| 5,108,063 | A | 4/1992 | Koerber, Sr. et al. | |
| 5,136,737 | A | 8/1992 | Reppas et al. | |
| 6,394,830 | B1 | 5/2002 | Huang | |
| 6,401,276 | B1 | 6/2002 | Sherman | |
| 6,978,499 | B2 * | 12/2005 | Gallant et al. | 5/600 |

FOREIGN PATENT DOCUMENTS

GB 945279 12/1963

* cited by examiner

*Primary Examiner*—Michael Trettel
(74) *Attorney, Agent, or Firm*—Barnes & Thornburg LLP

(57) ABSTRACT

A headwall for use in a healthcare facility maternity area is provided. The headwall comprises patient care equipment and a post-delivery bed disposed in the headwall to have an upwardly extending storage position and an outwardly extending use position. The headwall may provide a docking station for a birthing bed on which the delivering mother will be positioned during delivery.

14 Claims, 2 Drawing Sheets

FOLDOUT BED HEADWALL STRUCTURE

CROSS-REFERENCE TO RELATED APPLICATIONS

This application is a U.S. national counterpart application under 37 C.F.R. § 371(b) of PCT international application serial no. PCT/US2005/018965 filed May 31, 2005, which claims the benefit, under 35 U.S.C. § 119(e), of U.S. Provisional Patent Application Ser. No. 60/576,661 filed Jun. 3, 2004, which is hereby incorporated by reference herein.

BACKGROUND OF THE INVENTION

The present invention relates to maternity beds and headwall structures to support the delivery procedures and post delivery recovery.

It is common practice to place the delivering mother on a maternity bed or birthing bed which is positioned or docked adjacent a headwall which is equipped with all sorts of patient care equipment to support the delivery process and, in fact, any event that may occur during the delivery process. Such maternity beds are rather complicated structures with a foot section which is typically removable and with separate and articulating leg and foot support sections. This type of maternity bed is well known and it is very important to have the delivering mother on such a bed to deal with whatever event may occur during the birthing process. Once the infant is delivered, however, and the mother is no longer in need of further procedures, such a maternity bed is no longer required in the patient room. What the mother needs is rest and comfort.

The headwall structures against which such birthing beds are docked typically comprise several different types of patient care equipment including gas outlets, electrical plug-ins for various types of medical equipment and diagnostic equipment.

SUMMARY OF THE INVENTION

The present invention comprises a system that has one or more of the following features or combinations thereof, which alone or in any combination may comprise patentable subject matter.

A headwall system is provided for use in a hospital room or other healthcare facility maternity area. The headwall system comprises patient care equipment to support the infant delivery and care process. The headwall system provides a docking position for a birthing bed on which the delivering mother will be positioned during delivery. The headwall system will provide electrical service outlets for the birthing bed, and the headwall system will contain or comprise a plurality of patient care equipment normally associated with the birthing process including diagnostic equipment and monitors and IV equipment. It is contemplated that the headwall system will comprise all of the patient care equipment reasonably required to handle events which may occur during the birthing process. Such equipment may be covered by cabinet doors, facade, and the like to provide a pleasing, home-like appearance which is not likely to raise apprehension on the part of the delivering mother or any person accompanying her.

It is contemplated that the delivering mother will be placed on a conventional maternity bed and moved into the hospital room where the headwall structure is located or placed on a maternity bed which is already in such a room. Maternity beds are designed to be movable into and out of various rooms, and the doors of a typical hospital accommodate the width of the maternity beds.

The headwall system comprises a post-delivery bed disposed in the wall structure to have an upwardly extending storage position and an outwardly extending use position. The post-delivery bed may be mounted to the wall structure to be pivotal between its storage position and its use position in a manner similar to the movement of the well known Murphy or foldout bed. While foldout beds are well known, and have been used for generations, they are not known to be built into the headwall structures in hospitals and integrated with other equipment in the headwall structure. It is also not known to have such a post-delivery bed mounted in a headwall structure and comprising an articulating mattress support frame having a seat section and an upper body section and leg and foot section tiltable relative to the seat section.

Illustratively, the post-delivery bed is mounted in the headwall structure to be pivotable or tiltable in some fashion between its vertical storage position and its horizontal use position. A gas spring or other such means will be provided to support the weight of the post-delivery bed in its movement between its storage position and its use position. It will be appreciated that such a bed with an articulating mattress frame and the weight associated therewith may be supported by springs, counterbalance mechanisms, hydraulic actuators, gas springs and the like to assist the caregiver in moving the bed between its positions.

Typically, a facade will be provided to cover the post-delivery bed in its storage position in the headwall structure. Such a facade may illustratively be doors or panels which are both pivotable and slidable to positions exposing the post-delivery bed. The post-delivery bed may be a double wide bed to accommodate the mother after the delivery and potentially the father if he is available.

It is contemplated that at least one side rail may be movable into use position disposed alongside the post-delivery bed in its use position. This at least one side rail may have a storage position in the headwall structure from which it swings or clocks into its use position extending alongside the post-delivery bed. Illustratively, a side rail may be provided at each side of the post-delivery bed in its use position, with each side rail being swingable or movable upwardly to its use position. Such siderails may be coupled to the post-delivery bed or coupled to the headwall structure.

A bassinet may be provided to support the newborn infant. The bassinet may have a storage position in the headwall structure and a use position adjacent the mother and over the post-delivery bed. The bassinet may be supported on a radial arm assembly for movement between a storage position and its use position. The assembly may comprise a first radial arm pivotable outwardly from the structure and a second radial arm carried by and pivotable on the first radial arm. The bassinet will be supported on the second radial arm. Illustratively, a vertically extendible column supporting the bassinet at selectable adjustable heights on the second radial arm will be provided with the first and second radial arms being pivotable about vertical axes.

Thus, the present disclosure contemplates a birthing process in which the mother is placed on a conventional maternity bed during the delivery procedure and then, as soon as it is reasonable to do so, the mother is placed in a post-delivery bed which is pulled outwardly from the headwall structure. The maternity bed is no longer required, and may be wheeled out of the patient room to be used in another delivery process. Siderails, if required, may be pulled upwardly from the sides of the post-delivery bed to be adjacent the post-delivery bed.

Such siderails, located near the head end of the post-delivery bed, may carry the controls for articulating the bed surface and selecting environmental lighting and entertainment such as TV, DVD player and radio.

The newborn infant may be placed in a bassinet which is arranged to be positioned over the post-delivery bed so that the mother will have immediate access to the newborn infant. The bassinet will be carried on a radial arm assembly and a vertically adjustable column so that the infant can be positioned at the most convenient location for the new mother. To provide an even more comfortable arrangement, the post-delivery bed may be a double bed to be wider and more flexible than a typical maternity bed.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
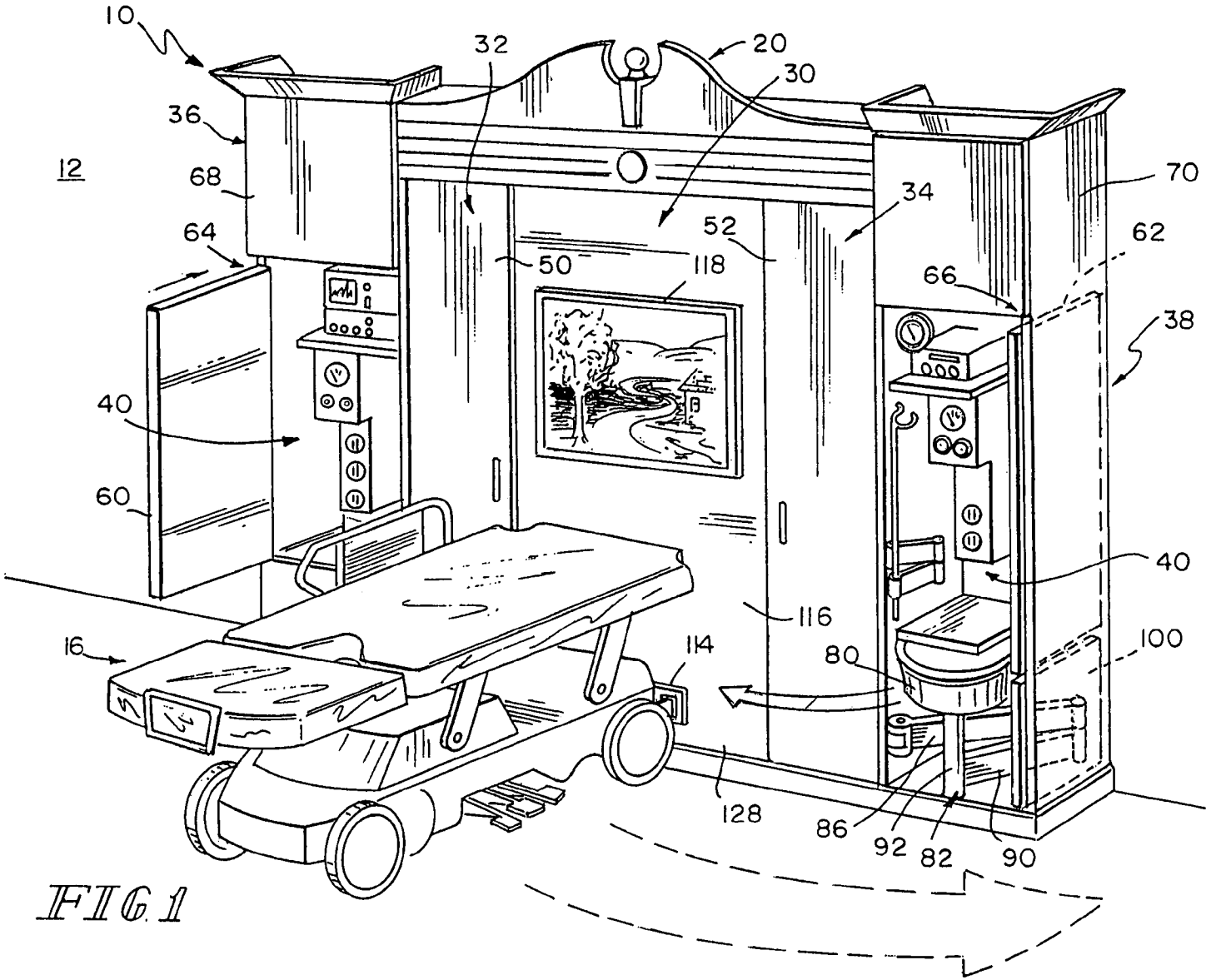
FIG. 1 is a perspective view of a headwall system within a hospital room showing a birthing bed docked to a docking station of the headwall system, and further showing various patient care equipment stored within two clinical cabinets located on either side of the birthing bed, the clinical cabinets being configured to open to provide access to the patient care equipment.
Figure 2:
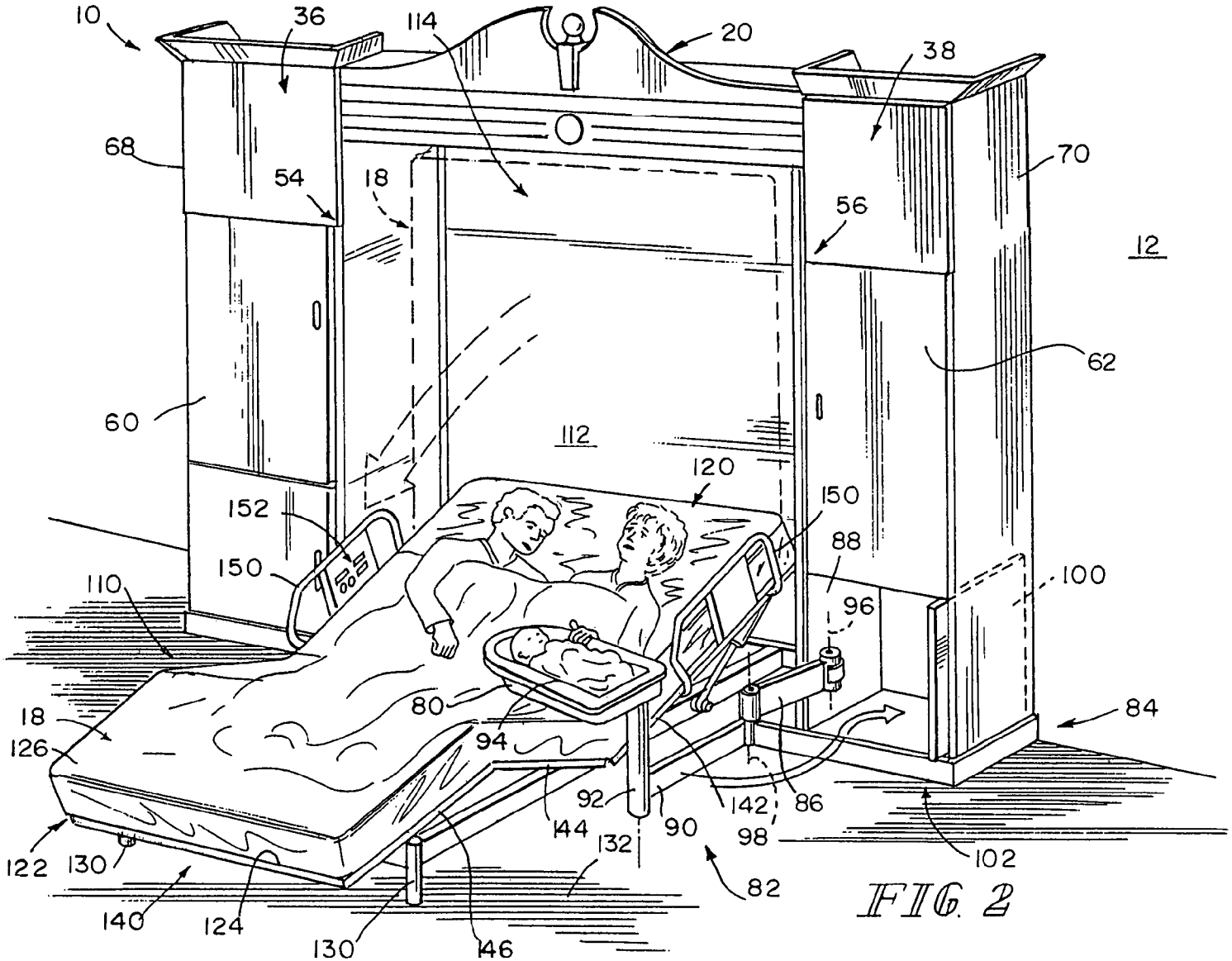
FIG. 2 is a perspective view of the headwall system of FIG. 1 showing the birthing bed having been removed from the hospital room and replaced by a fold-down, double-wide foldout bed of the headwall system shown in an outwardly extending use position and further showing a baby bassinet supported by a radial arm assembly of the headwall system.

Referring to FIGS. 1 and 2, a headwall system 10 is provided for use in a hospital room or other healthcare facility. Specifically, headwall system 10 may be used in a maternity room 12 of a healthcare facility to allow the room 12 to be used as both a labor and delivery room as well as a recovery and post-partum room. As shown in FIG. 1, the headwall system 10, therefore, includes a birthing bed docking station or bed locator 14 for docking a birthing or maternity bed 16 to the headwall system 10. The terms "hospital" and "healthcare facility" are used broadly to include nursing homes, outpatient clinics, doctors' offices, medical care facilities, and the like.

The headwall system 10 further includes a post-delivery bed 18 shown in FIG. 2. The post-delivery bed 18 is normally stored within a central portion 20 of the headwall system 10 as shown in FIG. 1. The post-delivery bed 18 is configured to be movable from an upwardly extending storage position shown in FIG. 1 to an outwardly extending use position shown in FIG. 2. In use, therefore, the birthing bed 16 may be docked to the docking station 14 of headwall system 10 for the mother to use during labor and delivery. Once the baby has arrived, however, the birthing bed 16 may be removed from the room 12 and the post-delivery bed 18 may be folded down to its outwardly extending use position to allow the mother, infant, and any family members, such as, for example, the father, to comfortably remain in the same room 12 before, during and after labor and delivery.

Illustratively, the birthing bed docking station 14 is generally centrally located with respect to the width of the overall headwall system 10. The docking station 14 may be compatible with any number of birthing beds for labor and delivery and operates to couple the bed to the headwall system 10 in conventional fashion. The docking station 14 also operates to electrically couple the birthing bed 16 to the headwall system 10 to provide power to any electrical components of the bed such as the bed controls often located on the siderails of the bed, for example. It will be appreciated that bed docking stations, such as, for example, the birthing bed docking station 14, are widely known in the art to dock hospital beds to headwalls.

Looking to FIG. 1, the headwall system 10 includes a central component 30, two side components 32, 34 coupled to and flanking the central component 30, and two clinical components 36, 38 coupled to and flanking the side components 32, 34. The terms "components" and "cabinets" are used herein interchangeably, and each is intended to broadly cover the meaning of both. In the upwardly extending storage position, the post-delivery bed 18 is stored out of sight behind the central and side components 30-34 of the headwall system 10 between the clinical cabinets 36, 38. The clinical cabinets 36, 38 house patient care equipment and service connectors, collectively referred to herein as the patient care equipment 40.

It is contemplated that the clinical cabinets 36, 38 will comprise all of the patient care equipment and service connectors reasonably required to handle events which may occur during the birthing process. Illustratively, the patient care equipment may include heart monitoring equipment, infusion pumps, intra-venous pumps, equipment monitors, defibrillators, and the like, many of which directly connect to the patient via lines or tubes. Illustratively, the service connectors may include electrical ports, medical gas outlets, vacuum outlets and communication ports (such as video, audio, data, etc.).

The central and side components 30-38 of headwall system 10 may be modular so that one side component may be replaced with a different side component for use beside a particular central component. Illustratively, the outer appearance of the headwall system 10 is similar to that of hotel or family room type furniture, yet the headwall system 10 houses all of the patient care equipment 40 reasonably required to handle events which may occur during the birthing process. Illustratively, the outer doors and walls of the headwall system 10 may be made of wood or have a faux-wood finish to them. As shown in FIG. 1, the headwall system 10 may be adorned with intricate trim and artwork. Thus, when the headwall system 10 is incorporated into a hospital room, as shown in FIGS. 1 and 2, the overall appearance of the room is more relaxing and welcoming for the patient and other family members who may be spending significant amounts of time in the room.

As shown in FIG. 1, the side components 32, 34 of headwall system 10 include narrow and tall doors 50, 52 located on the opposite sides of the docking station 14. The doors 50, 52 are shown in a closed position in FIG. 1. The doors 50, 52 may be swung open and slid inwardly into respective narrow tracks or openings 54, 56 adjacent the associated side components 32, 34 as shown in FIG. 2. Illustratively, the narrow track 54 is located between the side component 32 and the associated clinical cabinet 36. Likewise, the narrow track 56 is located between the side component 34 and the associated clinical cabinet 38. The tracks 52, 54 are exposed when the doors 50, 52 are swung open. The post-delivery bed 18 is normally disposed within the central and side components 30-34 of the headwall system 10 as shown in phantom in FIG.

2. After delivery, the post-delivery bed 18 is pulled down to the outwardly extending use position shown in solid in FIG. 2.

Thus, the delivering mother may be placed on the conventional maternity or birthing bed 16 docked to the docking station 14 in the headwall system 10 during labor and delivery while the post-delivery bed 18 is stored behind the central and side components 30-34 of the headwall system 10. After delivery, the birthing bed 16 may be un-docked from docking station 14 and wheeled out of the patient room 12. The post-delivery bed 18 may then be folded down to the horizontal use position, and the mother placed on the post-delivery bed 18 during recovery for the rest of her stay at the hospital or healthcare facility.

As shown in FIG. 1, the clinical cabinets 36, 38 of headwall system 10 include doors 60, 62 to conceal the patient care equipment 40 when the equipment 40 is not in use. The doors 60, 62 are shown in a closed position in FIG. 2. When access to the patient care equipment 40 is needed such as, for example, during labor and delivery, the doors 60, 62 may be swung open and slid inwardly into respective narrow tracks or openings 64, 66 adjacent the associated side walls 68, 70 of the head wall system 10 as shown in FIG. 1. Illustratively, the narrow track 64 is located between the clinical cabinet 36 and the side wall 68 of the headwall system 10. Likewise, the narrow track 66 is located between the clinical cabinet 38 and the side wall 70 of the headwall system 10. The tracks 62, 64 are exposed when the doors 60, 62 are swung open.

Referring to FIG. 2, a bassinet 80 may be provided to support the newborn infant adjacent the mother. The bassinet 80 may be supported on a radial arm assembly 82 for movement between a storage position and a use position. In the storage position, the bassinet 80 is stored inside a side cabinet 84 located below the clinical cabinet 38 of the headwall system 10. In the use position, the bassinet 80 is movable to a position next to the mother and over the post-delivery bed 18. The radial arm assembly 82 may comprise a first radial arm 86 pivotable outwardly from the wall structure 88 and a second radial arm 90 carried by and pivotable on the first radial arm 86. The bassinet 80 is supported on the second radial arm 90.

Illustratively, a telescopic column or post 92 extends between the second radial arm 90 and the bassinet 80 to support the bassinet 80 at selectable adjustable heights relative to the second radial arm 90. The bassinet 80 may, in turn, be mounted on a perimeter frame 94 that is pivotally mounted to the telescopic post 92. Both the first and second radial arms 86, 90 of the radial arm assembly 82 are pivotable about respective vertical axes 96, 98.

The cabinet 84 housing the bassinet 80 may include a door 100 to conceal the bassinet 80 when the bassinet 80 is not in use. The door 100 is shown in a closed position in FIG. 1. When access to the bassinet 80 is needed, the door 100 may be swung open and slid inwardly into a narrow track or opening 102 adjacent the associated side wall 70 of the head wall system 10 as shown in FIG. 2. The track 102 is exposed when the door 100 is swung open.

The post-delivery bed 18 includes a deck 110 coupled to a wall structure 112 for pivoting movement between the outwardly extending use position shown in FIG. 2 where the deck 110 extends generally horizontally from the wall structure 112 and the upwardly extending storage position shown in FIG. 1 where the deck 112 is received in a deck-receiving space or cavity 114 in the wall structure 112. The deck 110 is movable between the outwardly extending use position and the upwardly extending storage position in a manner similar to the movement of the well known Murphy or foldout bed. When the post-delivery bed 18 is closed, the underside 116 of the deck 110 is generally flush with the forwardly facing surfaces of the wall structure 112 so as to appear as a continuous part thereof. The underside 116 of the deck 110 may be adorned with artwork 118 to provide a pleasing facade so that the patient, family members and visitors find the hospital environment less intimidating.

Alternatively, the central component 30 may include doors (not shown) for enclosing the post-delivery bed 18 when the bed 18 is disposed in the upwardly extending storage position. Each door may be configured to be swung open and slid inwardly along a narrow track or opening adjacent a side wall of the deck-receiving space 114 to a storage position.

The deck 110 includes a head end 120, a foot end 122 and an upwardly facing surface 124. A mattress 126, such as, for example, an air mattress or a foam mattress, rests on the upwardly facing surface 124 of the deck 110. A plurality of straps (not shown) secure the mattress 126 to the deck 110 to hold it in place when the deck 110 is raised to the upwardly extending storage position. It is understood that although straps (not shown) are used in the illustrated embodiment to secure the mattress 126 to the deck 110, other suitable fasteners may very well be used. Some example of such fasteners are Velcro strips, loop and tie fasteners, hook and eye fasteners, clips, snaps, zippers, etc. A lower portion 128 (shown in FIG. 1) of the central cabinet 30 may house equipment such as, for example, a compressor, a motor, a controller, tubing, valves, etc. for inflating the air mattress 126.

It is contemplated that a plurality of hinges (not shown) near the head end 120 of the deck 110 couple the deck 110 to the wall structure 112 so that the deck 110 pivots relative to the wall structure 112 about a laterally extending axis (not shown) between the raised storage position and the lowered use position. A retainer or latch (not shown) holds the deck 110 in the deck-receiving cavity 114 when the deck 110 is raised. In the lowered use position, the deck 110 extends generally outwardly from the wall structure 112 and the head end 120 of the deck 110 is positioned near the back wall of the wall structure 112.

A pair of legs 130 are pivotally coupled to the deck 110 near the foot end 122 to pivot between a raised storage position where the legs 130 lie in respective leg-receiving cavities (not shown) in the underside 116 of the deck 110 and a lowered use position where the legs 130 rest on the floor 132 to support the foot end 122 of the deck 110. Illustratively, hinges (not shown) near the foot end 122 couple the legs 130 to the deck 110 so that the legs 130 pivot relative to the deck 110 about a laterally extending axis (not shown). It will be appreciated that the legs 130 may be vertically extendible so that the height of the deck 110 can be adjusted when the deck 110 is in the lowered use position, for example, to permit easy ingress and egress.

When the legs 130 are received in the leg-receiving cavities in the deck 110, outwardly facing surfaces of the legs 130 are generally coplanar with the undersurface 116 of the deck 110 so as to appear as a continuous part thereof. Retainers or locks (not shown) hold the legs 130 in the leg-receiving cavities. Latches (not shown) lock the legs 130 in the lowered use position where the legs 130 rest on the floor 132 to support the foot end 122 of the deck 110. The terms "retainer", "latch" and "lock" are used interchangeably, and each is intended to broadly cover the meaning of all.

Illustratively, the deck 110 includes an articulating mattress support frame 140 to provide the post-delivery bed 18 with all the articulation of a normal low acuity hospital bed. As shown in FIG. 2, the articulating mattress support frame 140 includes longitudinally spaced apart upper body or head section 142, seat section 144 and leg or foot section 146, which are tiltable relative to each other. It will be appreciated that a variety of mechanisms may be used to provide for articulation of the head and foot sections 142, 146 relative to the seat section 144. Such articulation mechanisms to power the head and foot sections 142, 146 are well known in the art. Such mechanisms may be mounted in a space between the head section 142 and the deck 110.

A gas spring or other such means (not shown) may be provided to support the weight of the deck 110 in its movement between the storage and use positions. It will be appreciated that such a deck may be supported by springs, counterbalance mechanisms, hydraulic actuators, gas springs and the like to assist the caregiver in moving the deck between its storage and use positions. Alternatively, an actuator (not shown) such as, for example, an electric motor, may be provided to move the deck 110 between its storage and use positions.

In some embodiments, a siderail 150 is coupled to each side of the head section 142 of the deck 110. Each siderail 150 is movable like a normal bed siderail between an out-of-the-way storage position below the deck 110 and a use position alongside the head section 142 of the deck 110 as shown in FIG. 2. The siderails 150 are only present at the head end 120 of the deck 110 since the bed 118 is intended to be a family bed. The siderails 150 may include controls 152 needed for articulating the bed 18. In addition, the siderails 150 may include controls 152 needed for selecting environmental lighting and entertainment, such as, for example, TV, DVD player and radio.

In some embodiments, the siderails 150 are coupled to the wall structure 112 for pivoting movement between raised storage positions within the headwall system 10 and lowered use positions (best shown in FIG. 2) alongside the head section 142 of the deck 110. The siderails 150 are movable independent of the post-delivery bed 18. The siderails 150 are generally perpendicular to the floor 132 in their raised storage positions and generally parallel to the floor 132 in their lowered use positions. The siderails 150 have associated clocking mechanisms that allow them to lower to their respective use positions alongside the head section 142 of the deck 110. When needed, the siderails 150 are lowered to their respective use positions. The siderails 150 are pivoted up into the headwall system 10 when access to the patient is needed. Latches (not shown) are provided to hold the siderails 150 in their respective storage positions. The siderails 150 do not travel with the post-delivery bed 18 when the bed 18 is lowered to its use position, but remain stationary in their storage positions. However, the siderails 150 travel with the post-delivery bed 18 to their respective storage positions when the bed 18 is raised to its storage position. This articulation allows the post-delivery bed 18 to pivot up and store within the headwall system 10 with the siderails 150 alongside the bed 18.

A stow-away footboard (not shown) may be coupled to the deck 110 near the foot end 122. An overhead task light (not shown) may be mounted to the back wall of the wall structure 11 or integrated into the ceiling of the deck-receiving cavity 114. A switch (not shown) may be located on one of the side walls of the wall structure 112 to operates the overhead light. Alternatively, in some embodiments, the overhead light may be configured to be automatically turned on the when the deck 110 is lowered to the use position.

Thus, the present disclosure contemplates a birthing process in which the mother is placed on a conventional maternity bed during the delivery procedure and then, as soon as it is reasonable to do so, the mother is placed in a post-delivery bed which is pulled outwardly from the headwall structure. The maternity bed is no longer needed and may be wheeled out of the patient room to be used in another delivery process. Siderails, if required, may be pulled upwardly from the sides of the post-delivery bed to be adjacent the post-delivery bed. Such siderails may carry the controls for articulating the bed surface and selecting environmental lighting and entertainment such as TV, DVD player and radio. The newborn infant may be placed in a bassinet which is arranged to be positioned over the post-delivery bed so that the mother will have immediate access to the newborn infant. To provide an even more comfortable arrangement, the post-delivery bed may be a double bed to be wider and more flexible than a typical maternity bed.

While the disclosure is susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure as defined by the appended claims.

The invention claimed is:

1. A headwall for use in a healthcare facility maternity area, the headwall comprising patient care equipment, a post-delivery bed coupled to the headwall and movable between an upwardly extending storage position in which a mattress of the post-delivery bed is inaccessible and an outwardly extending use position in which the mattress is accessible for use by a person, and a bassinet having a storage position in the headwall and a use position adjacent the post-delivery bed.

2. The headwall of claim 1, wherein the patient care equipment comprises any one or more of the following: electrical outlets, medical gas outlets, air outlets, vacuum outlets, and communication ports.

3. The headwall of claim 1, comprising a docking position for a birthing bed.

4. The headwall of claim 1, wherein the post-delivery bed is mounted in the headwall to pivot between its storage position and its use position.

5. The headwall of claim 1, further comprising a facade covering the post-delivery bed in its storage position.

6. The headwall of claim 1, further comprising cabinets to store patient care equipment disposed on opposite sides of the post-delivery bed.

7. The headwall of claim 1, wherein the post-delivery bed includes at least one side rail movable to a use position disposed alongside the post-delivery bed.

8. The headwall of claim 7, wherein the at least one side rail has a storage position from which it swings into its use position alongside the post-delivery bed.

9. The headwall of claim 1, further comprising a radial arm assembly to support the bassinet for movement between its storage position and its use position.

10. The headwall of claim 9, wherein the radial arm assembly comprises a first radial arm pivotal outwardly from the headwall, and a second radial arm carried by and pivotal on the first radial arm, the bassinet being supported on the second radial arm.

11. The headwall of claim 10, further comprising a vertically extendible column to support the bassinet at selected adjustable heights on the second radial arm, the first and second radial arms being pivotal about their respective vertical axes.

12. The headwall of claim 1, wherein the post-delivery bed comprises an articulating mattress support frame having a seat section, and an upper body section and a foot section tiltable relative to the seat section.

13. The headwall of claim 1, wherein the post-delivery bed is a double wide bed.

14. The headwall of claim 1, further comprising means for supporting the weight of the post-delivery bed as it moves between its storage position and use position.

* * * * *